US010271667B2

(12) United States Patent
Wallinder

(10) Patent No.: US 10,271,667 B2
(45) Date of Patent: Apr. 30, 2019

(54) COVERING ARRANGEMENT FOR A REFRIGERATED FOOD BAR ARRANGEMENT AND A FOOD BAR ARRANGEMENT WITH SUCH A COVERING ARRANGEMENT

(71) Applicant: Picadeli AB, Göteborg (SE)

(72) Inventor: Jonas Wallinder, Vreta Kloster (SE)

(73) Assignee: PICADELI AB, Gothenburg (SE)

( * ) Notice: Subject to any disclaimer, the term of this patent is extended or adjusted under 35 U.S.C. 154(b) by 0 days.

(21) Appl. No.: 15/314,329

(22) PCT Filed: May 12, 2015

(86) PCT No.: PCT/SE2015/050534
§ 371 (c)(1),
(2) Date: Nov. 28, 2016

(87) PCT Pub. No.: WO2015/183156
PCT Pub. Date: Dec. 3, 2015

(65) Prior Publication Data

US 2017/0196375 A1 Jul. 13, 2017

(30) Foreign Application Priority Data

May 29, 2014 (SE) ..... 1450649

(51) Int. Cl.
*A47F 3/04* (2006.01)
*A47F 10/06* (2006.01)
*A47F 3/00* (2006.01)

(52) U.S. Cl.
CPC ..... *A47F 3/043* (2013.01); *A47F 3/007* (2013.01); *A47F 3/0434* (2013.01); *A47F 10/06* (2013.01); *A47F 2010/065* (2013.01)

(58) Field of Classification Search
CPC ..... A47F 3/043; A47F 3/007; A47F 10/06; A47F 2010/065; A47F 3/0469;
(Continued)

(56) References Cited

U.S. PATENT DOCUMENTS 4,572,598 A * 2/1986 Moore, Jr. ..... A47F 3/0439 108/96
4,920,760 A * 5/1990 Muhlack ..... A47F 3/001 312/284
(Continued)

FOREIGN PATENT DOCUMENTS

DE 1129514 B 5/1962
EP 0269881 A2 6/1988
(Continued)

OTHER PUBLICATIONS

Sweden Patent and Registration Office, Int'l Search Report in PCT/SE2015/050534, dated Sep. 22, 2015.
(Continued)

*Primary Examiner* — Hiwot E Tefera
(74) *Attorney, Agent, or Firm* — Jeffrey S. Melcher; Melcher Patent Law PLLC

(57) ABSTRACT

A covering arrangement for a food bar has at least one covering element with front and rear sections, and two first side sections disposed between the front and rear sections along opposite outer edges. The rear section extends in a substantially vertical plane. The covering arrangement also has a mounting structure with at least first and second mounting elements extending in a substantially vertical direction. The covering elements are movable in a vertical direction relative to the mounting elements, allowing the covering elements to move between a lower closed position and an upper open position. The covering arrangement further comprises second side sections fixedly or detachably connectable to the food bar such that when a covering
(Continued)

element is closed, the first side sections are disposed adjacent to, and in parallel with, the second side sections, and when the covering element is open, the second side sections act as side covers.

16 Claims, 7 Drawing Sheets

(58) Field of Classification Search
CPC ..... A47F 3/04; A47F 3/0408; A47F 3/0434; A47F 3/145; A47F 3/0486; A47F 3/0439; A47F 3/0413; A47F 5/108; A47F 3/00; B65D 43/20; B65D 43/16; A47B 2200/0041; A47B 31/02; A47G 19/26; F25D 2400/08; F25D 2400/10; F25D 3/06; F25D 23/021
USPC .... 62/246; 312/114, 116, 140.4, 140.1, 284, 312/312, 138.1; 220/345.1, 345.4, 345.5
See application file for complete search history.

(56) References Cited

U.S. PATENT DOCUMENTS 6,427,468 B1 * 8/2002 Topper ..... A47F 3/043 62/248
6,634,668 B2 * 10/2003 Urffer, III ..... A47F 5/108 280/47.35
7,607,550 B2 * 10/2009 Lin ..... B25H 3/021 206/509
8,692,160 B2 * 4/2014 Brown ..... H05B 3/744 219/220
8,820,859 B1 * 9/2014 Kim ..... A47F 3/0469 312/116
2007/0062209 A1 * 3/2007 Giulietti ..... A47F 3/0434 62/246
2008/0000398 A1 * 1/2008 Barkley ..... A47G 19/26 108/90
2008/0289514 A1 * 11/2008 Speranza ..... A47B 31/02 99/468
2011/0080075 A1 4/2011 Matus, Jr.
2011/0204755 A1 * 8/2011 Yingst ..... A47F 3/007 312/140.1
2015/0203293 A1 * 7/2015 Boesch ..... B65F 1/1646 220/813
2016/0174736 A1 * 6/2016 Gonz lez Morlans ..... A47F 3/043 312/116

FOREIGN PATENT DOCUMENTS

EP 2218360 A1 8/2010
FR 2193317 A5 2/1974
WO 2014/148968 A1 9/2014

OTHER PUBLICATIONS

European Patent Office, Extended Euro. Search Report in PCT/SE2015/050534, dated Dec. 17, 2017.

* cited by examiner

COVERING ARRANGEMENT FOR A REFRIGERATED FOOD BAR ARRANGEMENT AND A FOOD BAR ARRANGEMENT WITH SUCH A COVERING ARRANGEMENT

TECHNICAL FIELD

The present invention relates to a covering arrangement for a food bar arrangement as described herein. The invention also relates to a food bar arrangement with such a covering arrangement as described herein.

BACKGROUND

In recent times it has become more and more popular to offer fresh food, salads, fruit vegetables, chicken, but also cooked and prepared food, or so called healthy food, from what often is called a salad bar, where the customer can pick and compose a meal from a number of different products kept in canteens or pans. However, since the food products may remain for some time in the canteens, which may be accessed by quite a large number of persons, the requirements as to an appropriate and hygienic storage capability are high. Furthermore the food products have to be kept under such conditions, and at such a temperature, that bacterial growth is prevented and the products can be kept fresh, appetizing and are not ruined or deteriorated in any way due to the storing.

To be able to maintain an accurate temperature, e.g. above 0° (to avoid that the products be frozen), but below 8° C., several different arrangements have been proposed.

Most known arrangements use cooling elements below the canteens, but it is difficult to obtain an even temperature distribution in the food stored in the canteens, i.e. throughout the canteens, independently of the location of the food and of the canteens. This problem further is aggravated due to covering arrangements used to cover and protect the canteens with content frequently being opened by customers accessing the food, each time during a shorter or a longer time period Therefore some known arrangements use fan blowers for blowing cold air onto the products e.g. from above, or from below or sideways onto the canteens.

This is however disadvantageous for several reasons. First, it is not good from a hygienic point of view, bearing in mind that several individuals serve themselves from the canteens which means that air contaminated with bacteria etc. may be blown onto the food. Also other particles, e.g. dust may be blown onto the food. Second, due to the air flow, the food products may be dried out, and ruined, at least from an aesthetical point of view and the products will not look fresh, which may reduce the willingness of customers to buy and consume the products. Some articles may even loose taste and undergo unwanted changes.

These factors contribute in shortening the time period the products can be kept in the canteens, and they may have to be disposed of, even if they actually could have been stored for a longer time if stored under appropriate conditions.

Third, it is a waste of energy to have fan blowers active all the time. Moreover, the difficulties in maintaining an appropriate temperature throughout the entire contents in a canteen, may lead to production of microorganisms, which even may give rise to health hazards.

Since, as referred to above, in general a covering arrangement is used to protect the products in the canteens, the problems referred to above are even more accentuated, since the opening and closing of such covering arrangements will affect the temperature distribution. When such covers or lids are opened to provide a customer with access to the food products, air of a higher temperature will enter the canteens, which means that even more cooling is required. If fans are used, the products will then be even more exposed to cool air, and the drying effect will be further increased, which means that the time period that the products can be stored in the food bar will be even more shortened. In addition thereto, when the covering arrangements, or the lids, are opened, this will contribute to an even more uneven temperature distribution. Covering arrangements used in known food bars are fixedly hinged at the rear side of the canteens, or of the food bar, and when they are opened, pivoted or rotated, around a shaft at the rear, lower edge of the cover, warm air, at room temperature, will enter from the front side of the food bar, and from the short sides.

The more often the food bar is accessed, i.e. the more often the cover is opened, the larger the problems associated with keeping of an even temperature distribution will be, and the losses in cooling power will be considerable.

Another disadvantage is that covering arrangements, or lids, fixedly hinged at the rear side will, when opened, sweep out across the food bar tray slide. This is very uncomfortable for a customer, and may even have as an effect that food collected by a customer in a package or similar on the tray may be hit and fall down onto the floor or be spilt on the tray slide, when the customer, or another customer, opens or closes the cover.

SUMMARY

It is therefore an object of the present invention to provide a covering arrangement, particularly for a refrigerated food bar arrangement, and as initially referred to, through which one or more of the above mentioned problems can be solved.

A particular object is to provide a covering arrangement which assists in conferring a stable, even, temperature distribution throughout the bar, and the food products kept in a canteen or a pan (all canteens in the bar arrangement), and by which cooling power losses, due to the covering arrangement being opened, giving customers access to the food products, can be reduced as compared to known arrangements.

It is also an object to provide a covering arrangement which facilitates maintaining a stable, equal temperature throughout the bar, also when the food bar is accessed, i.e. when the covering arrangement, or the hood or the lid, is an open position.

Yet another object is to provide a covering arrangement which is easy and safe to handle and operate, to bring from an open to a closed position and vice versa.

It is also an object to provide a covering arrangement for a food bar which is not bulky and which does not protrude unnecessarily, which further does not take up much space, and which particularly is so formed and arranged that it does not hinder a customer serving himself and which does not interfere with plates or packages on a tray slide, irrespectively of being in an open position or a closed position, or in any intermediate position.

Still further it is a particular object to provide a covering arrangement which is easy to fabricate and mount.

It is a further object to provide a covering arrangement for a food bar which is easy to handle from a maintenance and cleaning point of view.

Another particular object is to provide a covering arrangement which is flexible.

Still further it is an object to provide a covering arrangement through which the need of using fans to compensate for cooling losses due to opening thereof can be reduced, or even eliminated Therefore a covering arrangement is provided which has the characterizing features as described herein.

Another object of the invention is to provide a food bar arrangement with a covering arrangement having the features as described herein through which one or more of the above mentioned objects can be fulfilled.

An object is also to provide a high standard refrigerated food bar arrangement, particularly of the type intended for self-service, but also for other purposes, e.g. in canteens in schools or restaurants or imbiss stands when staff are serving the customers.

It is also a particularly an object to provide an arrangement which can be operated without, and particularly does not necessitate the use of any fan blowers, or only to a limited extent, or which optionally can be used with or without fans, or with fans as an auxiliary equipment that may be activated or not.

Therefore a food bar arrangement is provided which has the characterizing features as described herein.

Advantageous embodiments are given by the respective appended sub-claims.

BRIEF DESCRIPTION OF THE DRAWINGS

The invention will in the following be further described in a non-limiting manner, and with reference to the accompanying drawings, in which.

DETAILED DESCRIPTION

Figure 1:
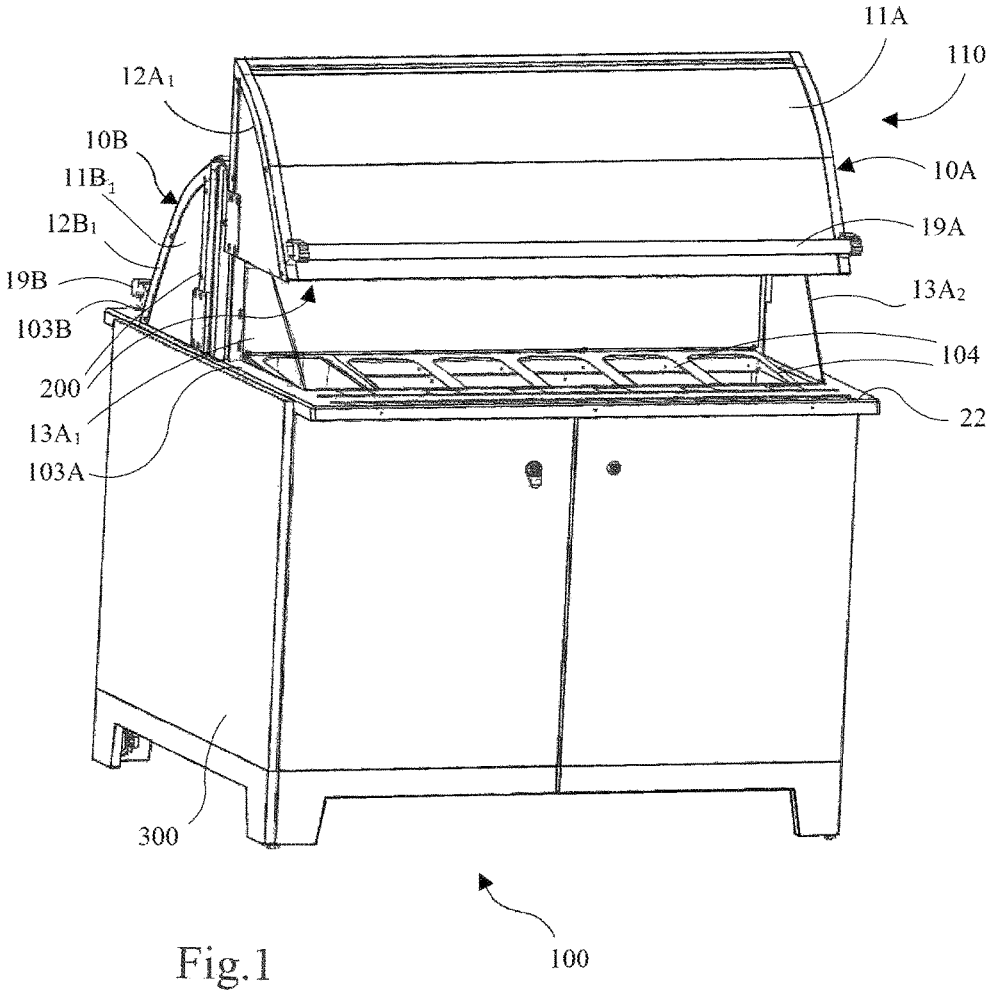
FIG. 1 is a perspective view showing a covering arrangement comprising two covering elements arranged on an exemplary dual food bar arrangement food wherein one of the covering elements is in an open position and the other is in a closed position.

FIG. 1 shows a covering arrangement 110 comprising two covering elements 10A,10B adapted to be used for a food bar arrangement 100, e.g. a salad bar, according to a first embodiment of the invention. It should be clear that a covering arrangement 110, here with two covering elements for a dual sided food bar, do not have to be used in connection with a food bar as the one shown in the Figures, but it/they can be used with any other food bar or similar where one or more of the problems discussed earlier in this application are encountered and need to be solved, e.g. to provide a covering arrangement which is easy to use, maintain, and/or to fabricate, and which assists in enabling the provisioning of an even temperature distribution, which is not bulky and hindering access to products or similar in a food bar or anything alike. It should also be clear that the food bar or similar does not have to be a dual food bar; it might just as well be a one sided food bar, or several food bars aligned, or a food bar with several adjacent, separate covering arrangements, each with one or more covering elements.

However, in the particular illustrated embodiment, the covering elements 10A,10B are used in connection with a food bar arrangement 100 which comprises canteen or pan holding arrangements 103A,103B adapted to receive and hold a plurality of canteens or pans 104 in which fresh food products are to be kept. It further comprises a refrigerating 200 for cooling the canteens, and hence the food products provided therein, for keeping the food products at a desired temperature, e.g. above 0° but below 8° C., or within a more specified temperature interval.

The holding arrangements 103A,103B comprise or are connected to cupboard or bench arrangements 300 comprising cold wells and being adapted to receive the canteens or pans in such a manner that openings of the canteens or pans make the food accessible for a customer from a first and a second outer side section of the holding arrangements 103A, 103B, hence allowing a customer to choose and pick from the canteens or pans, here from two sides.

The covering elements 10A,10B are adapted to cover the canteens or pans from above so that the content is protected in time periods between customers accessing the content, or when refilling the canteens or similar.

The covering elements 10A,10B can be transferred from an open position or an open state, in which access to the content in the canteens is provided. In FIG. 1 covering element 10A is in an open state, whereas covering element 10B is in a closed position preventing access and protecting the content in the canteens 104 on one side of the food bar. Each covering element 10A,10B comprises a front section 11A,11B exhibiting a vaulted shape, a rear section (not shown in FIG. 1; reference is particularly made to FIG. 7, reference numeral 15A) and two side sections $\mathbf{12}A_1$, $\mathbf{12}A_2$, $\mathbf{12}B_1$, $\mathbf{12}B_2$ (not all shown in FIG. 1; see also FIG. 2) interconnecting respective opposite outer edges of the respective front and rear sections in such a manner that two hoods or similar are formed, with one another facing, and extending in parallel to one another, substantially plane rear sections, which in a mounted state of the respective covering arrangement are disposed in a vertical manner, forming rear walls. The edges of the first side sections $\mathbf{12}A_1$, $\mathbf{12}A_2$, $\mathbf{12}B_1$, $\mathbf{12}B_2$ connecting to, or being arranged adjacent to, the rear section are vertically disposed (in a mounted state) whereas the edges connecting to the front sections taper upwardly to a location where front and rear section upper edges meet or are joined by means of a frame structure as will be further discussed below.

Said rear walls, or rear sections, are in an advantageous embodiment disposed at a distance from one another, leaving space for a refrigerating or cooling element 200, particularly a cooling tower, between them. The upper end of the cooling element or the cooling tower 200 in some embodiments is contiguous with the upper end of a mounted covering arrangement 100 (when the covering elements are in their closed positions).

In other embodiments the cooling element 200, or the covering arrangement 110, is adapted to have such a height that the upper end of the cooling element 200 will be disposed below the position assumed by the upper end or edge of the covering element(s) in its (their) closed position. Alternatively the cooling element(s) protrudes above the covering arrangement in its closed position, although its active portion, as far as its cooling functionality is concerned, preferably terminates at the upper end or edge of the covering arrangement.

It should however be clear that the covering arrangement according to the present invention with advantage also can be used irrespective of the location of any cooling element.

Each covering arrangement 10A,10B is here equipped with an actuating element 19A,19B, e.g. a gripping element, a handle or similar by means of which a user, e.g. a customer accessing the products in the canteens, can bring the covering arrangement 10A,10B from a closed position to an open position and vice versa. In the shown embodiments the actuating elements 19A,19B extend along the lower ends of the front sections 11A,11B, or adjacent said lower ends. The actuating elements may of course be of any other form or shape, disposed in any different manner, the purpose being to facilitate or enable that the covering arrangement to be opened/closed in an easy and safe manner. Preferably actuating elements 19A,19B are disposed all along the long side of the food bar, so that e.g. a customer in front of the food bar can open/close the covering element with ease irrespective of his current position.

The front section 11A,11B of a covering element 10A, 10B is preferably made of a transparent material, e.g. of any appropriate plastic material known in the art. The side sections and the rear sections may according to different embodiments be made of the same material as the front section, or of other appropriate materials, which may be the same or different for the side and the rear sections. Particularly also the side sections are made of a transparent material.

In order to transfer a covering element 10A,10B from a closed to an open position, it is moved in a vertical direction between a first, lower, position, the closed position, (covering element 10B in FIG. 1), in which it substantially is in contact with an upper side of a holding arrangement 103A, 103B, preventing access to the canteens, and a second, upper position (covering element 10A in FIG. 1) in which access is provided to the canteens or similar in a food bar.

The covering elements 10A,10B are movable between said first, closed, and said second, open, positions by means of the covering arrangement further comprising, or being connected to, a mounting (and driving) structure comprising guide rails in which a slide or pulley mounted on the covering element can run.

In order to bring a covering element 10A,10B from a closed position to an open position, a slight force has to be overcome to allow it to subsequently slide or move upwardly, substantially with no resistance, until it reaches the upper, open, position. Vice versa, when it is to be moved from the upper, open, position to the lower, closed, position, a slight force, somewhat higher than the slight force referred to above for the closing operation, has to be overcome after which it is moved automatically slowly downwards. Such opening and closing movements can be achieved in different manners as will be discussed below. An advantageous embodiment is discussed with reference to FIG. 3. As another option, gas springs can be used to allow the covering elements slide upwards and downwards with respect to a/the vertical mounting structure.

The mounting structure may be provided with vertical parallel guide rails for cooperation with the respective rear outer edges of a single cover element, or it may be a dual mounting structure adapted to receive two covering elements 10A,10B as in FIG. 1, which independently can slide up and down by means of respective guiding rails as will be further described below. It should however be clear that the transfer between the open, upper, position and the closed, lower, position can be achieved in many different ways, the important thing in this respect being that the covering element is moved by means of a vertical translation between an open and a closed position, and does not sweep out over the tray slide during the movement.

Another important feature is the provisioning of the first side sections 12$A_1$, 12$A_2$, 12$B_1$, 12$B_2$, and in particular of second, preferably, but not necessarily, fixed or detachably mountable, second side sections or additional side walls 13$A_1$,13$A_2$, 13$B_1$,13$B_2$ (the latter not shown in FIG. 1). Said second side sections 13$A_1$,13$A_2$,13$B_1$,13$B_2$ in advantageous embodiments have substantially the same, or a similar, shape as the first side sections 12$A_1$, 12$A_2$, but with slightly reduced dimensions so as to admit the first side sections to, in a closed position of the covering elements, be disposed on the outer sides of said second side sections, at a slight or minor distance therefrom, and in such a manner that said second side sections will be located closest to the canteens. Said second side sections will contribute in maintaining an even temperature distribution since it will prevent cool air from escaping from the region above the canteens when the covering element is in an opened position, and prevent warm air from entering the region.

Thus, through the particular arrangement of the rear sections of the covering elements adjacent to a cooling element, and movably with respect thereto, such that when a covering element is in an open position, the rear section is moved upwards, exposing a larger area of the cooling element, hence resulting in an increased cooling of the canteens, and further the implementation of the second side sections, the covering arrangement will, to a considerable extent, contribute to keeping an even temperature distribution in the food bar.

The cooling element 200 is in different advantageous embodiments arranged with respect to, or in, a holding arrangement 103 such that, when the canteens 104 are taken up therein, each canteen back wall, distant from an opposite canteen front wall located adjacent an inner side of the holding arrangement 103 at its outer side, where customer access is provided, will be located close to, facing it, preferably throughout the entire area forming the back wall.

The holding arrangement 103 in one embodiment, to which the invention however by no means is limited, comprises holding means adapted to hold the canteens or pans in an inclined position such that outer, upper, ends or side edges, of the canteens will be disposed at a lower level than opposing inner, upper ends, or side edges. Bottom sections of the holding arrangement may be disposed such that a distance is left between the bottom surface of the holding arrangement, forming a cold well, and the bottom portions of the canteens.

At least a part of the cooling arrangement will thus, in such an embodiment, be located adjacent the outer sides of the back walls of the canteens in a mounted position in a holding arrangement.

The covering arrangement according to the invention may be used for such a food bar arrangement, substantially as disclosed in PCT/SE2014/000028 claiming priority from Swedish patent application No. 1350368-5. In such an implementation a first portion of cooling arrangement protrudes above the upper edges of the back walls of canteens placed in the holding arrangement, whereas a second section of the cooling arrangement extends downwards towards, but ending at a certain distance from, the bottom of a well or trough of the holding arrangement such that it will be located adjacent substantially the entire back wall of each canteen. Through the positioning of the canteens in an inclined manner, outwardly, downwards away from the cooling arrangement, and at least a portion of the cooling arrangement extending upwardly above the inner upper side edges of the back walls, and the cooling arrangement being divided into a (communicating) upper and lower portion, separated by means of a dividing plate, the cooled air surrounding the upper inner part will flow downwards, outwards above the canteens containing the food, due to the dividing plate, hence not being allowed to pass, flow, vertically to the cold well, but is prevented to do so by the dividing plate. Through the second lower portion of the cooling arrangement covering the entire back walls of the canteens and a larger space being formed below the cooling arrangement, air with a lower temperature will be distributed and flow towards the outer end sections, under the canteens, cooling them from below as well as from above.

In the advantageous embodiment shown in FIG. 1 the holding arrangement 103 is adapted to receive one or more rows of canteens 104, the cooling or refrigerating arrangement 200 protruding in a central portion of the bar arrangement to a height substantially in line with the upper edges of rear sections, or rear walls, of the covering elements 10A, 10B when they are in a closed position. If the covering arrangement comprises but one covering element 10A or 10B, the rear section of such covering element is located adjacent the cooling or refrigerating arrangement 200.

The canteens in each row may be also in an embodiment as disclosed in FIG. 1 be held in an outwardly inclined position, e.g. so as to form an inclination angle $\alpha$ of between 5° and 10°, preferably between 6° and 9°, most preferably around 7.5° with a horizontal plane as in the above mentioned PCT/SE2014/000028, or alternatively at any other appropriate inclination angle, even including an in inclination angle of 0°.

Although FIG. 1 illustrates a covering arrangement 110 with two covering elements 10A,10B, it should be clear that the covering arrangement may have different forms and may be split into different sections; one for each a holding arrangement, or one section for two or more holding arrangements in a row, and comprise a common mounting structure allowing separate opening and closing of the covering elements, or with separate mounting structures for each covering element, the latter allowing an even more flexible assembly of independent modular single-sided food bar arrangements.

The covering arrangement 110 in FIG. 1 is provided on a food bar arrangement 100 with cupboards 300 provided with doors. It should be clear that this merely relates to one example of a food bar with which the covering arrangement can be used.

Figure 2:
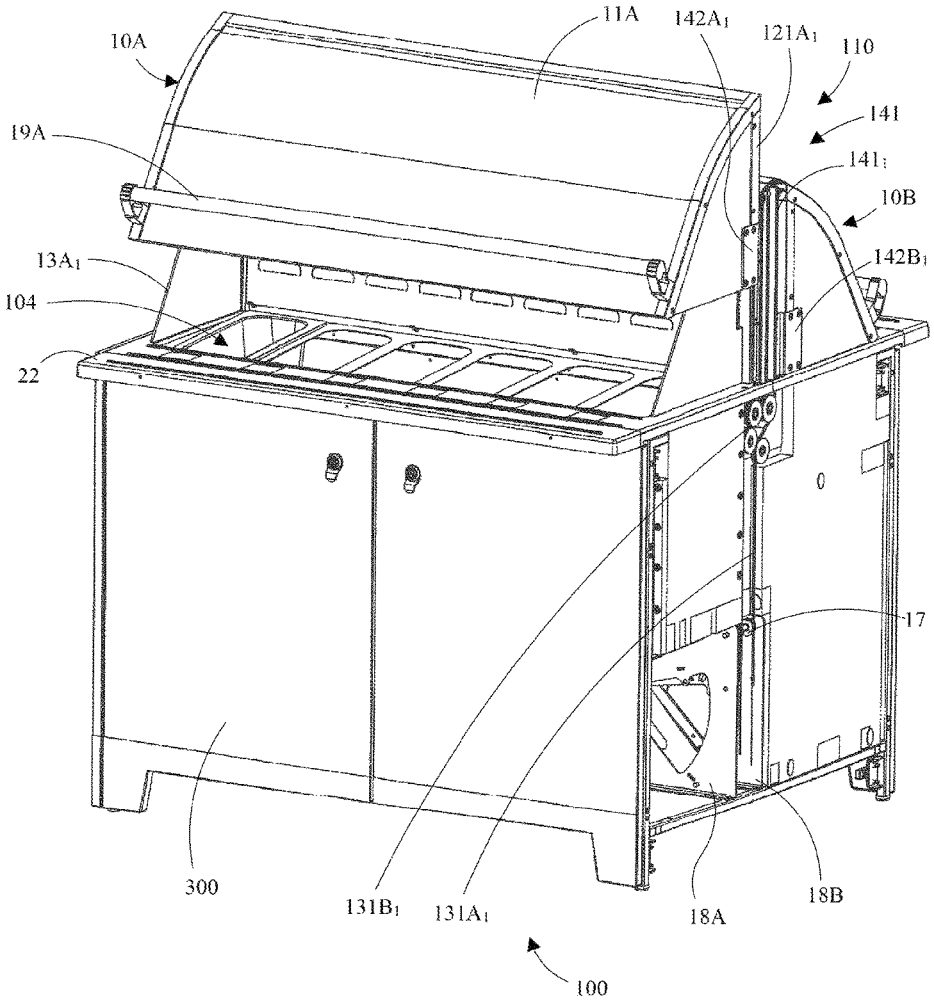
FIG. 2 is a perspective view of the covering arrangement of the exemplary food bar arrangement in FIG. 1, showing the mounting and driving structure of the covering elements.

FIG. 2 is a view in perspective of the covering arrangement 110 disposed in association with an exemplary food bar arrangement 100 as in FIG. 1, with one side wall of the cupboard of the food bar removed in order to illustrate in part the mounting structure 141 of the covering arrangement 110. The mounting structure 141 comprises a first mounting element $\mathbf{141}_1$, here called a driving mounting element, and a second mounting element $\mathbf{141}_2$ (not shown in FIG. 2) disposed at an opposite outer side of the covering arrangement. The first mounting element $\mathbf{141}_1$ here comprises a vertically disposed dual guide rail system with one guide rail for each covering element 10A,10B; the guide rails hence being arranged on opposite sides of a rail support, and being arranged to take up each a slide $\mathbf{142}A_2$, $\mathbf{142}B_2$ or carriage connected to a rear frame section $\mathbf{121}A_2$, $\mathbf{121}B_2$ and arranged for sliding up and down in the respective guide rail during opening and closing operations respectively. At the upper end of the mounting structure 141 a shaft (not shown) is transversally disposed such that at an outer end thereof, a dual wheel guide or trolley is provided, facing the rear side section or sections of the respective covering elements, (not shown) around which respective wires 131A, 131B (cf. FIG. 3) run via guide rollers $\mathbf{14}A_1$,$\mathbf{14}A_2$,$\mathbf{14}B_1$,$\mathbf{14}B_2$ and over a roller 17, and which, at the opposite ends, are connected to a respective spring 151A,151B, see FIG. 3, arranged in a bracket arrangement 18A,18B.

The springs 151A,151B are arranged to be pivotally connected, each separately, over a pivot point to allow the opening and the closing movement of the covering elements to be eccentrically driven, hence allowing a soft closure after being brought over the pivot point, and an automatic opening at crossing the pivot point in the opposite direction. As an alternative to a dual wheel guide or trolley there may be two separate upper trolleys or guiding elements, one for each covering element.

Figure 3:
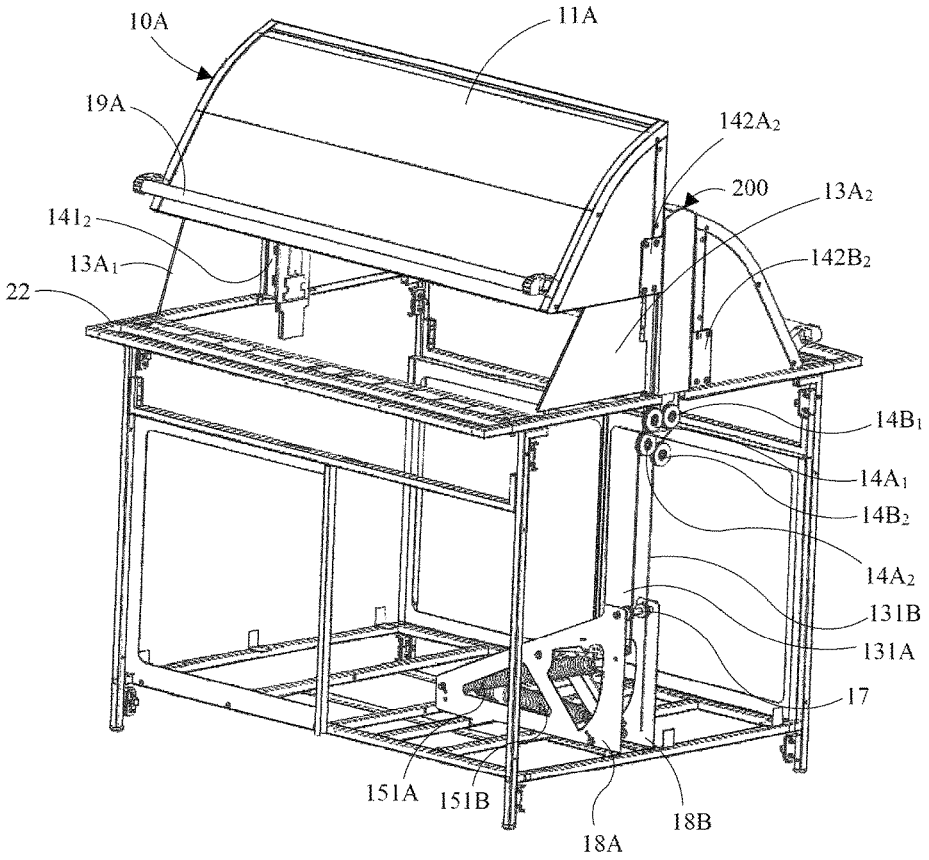
FIG. 3 is a perspective view of the dual food bar arrangement of FIG. 1 illustrating more in detail an embodiment of an operating structure of the covering arrangement.

FIG. 3 is a view similar to the view in FIG. 2, but wherein also the front section, here doors, of the food bar 100 are removed for illustrative purposes. For similar elements, the same reference numerals as in FIG. 2 are used. In FIG. 3 can be seen the wire 131A connected to the first covering element 10A running via guide rollers $\mathbf{14}A_1$,$\mathbf{14}A_2$. In FIG. 3 can also be seen the wire $\mathbf{131}A_2$ connected to the second covering element 10B running via guide rollers $\mathbf{14}B_1$,$\mathbf{14}B_2$, The purpose of these guide rollers is to compensate for the position of the spring and driving mechanism which here is displaced with respect to the transversal position of the guide rails The wires are connected to the respective springs 151A, 151B which when a respective covering element is actuated, are pivoted over the pivot point such as to provide an eccentrically controlled movement of said covering element.

FIG. 3 shows the position of the spring 151A for a covering element in an open position, where the spring exhibits a comparatively strong spring action, and the position of spring 151B for the covering element 10B in a closed position, corresponding to a position in which the spring 151B exhibits a weaker spring action.

Thus, a covering element can easily be opened, but once it is open, a higher spring action has to be overcome in order to close the covering element, hence avoiding any closing operation from unintentionally being initiated during access to a canteen, and preventing the cover from falling down, or unintentionally being closed, in which case a customer might be injured, or the cover be damaged.

In FIG. 3 is also shown the second mounting element $\mathbf{141}_2$, which is similar to the first mounting element $\mathbf{141}_1$, but which merely is adapted to take up the opposite carriage of a covering element in a guide rail and which is not connected to any spring mechanism. In alternative embodiments, or for large covering elements, a spring and drive mechanism could be provided on both sides.

As an alternative to the spring and drive mechanism shown in FIGS. 2 and 3, gas springs can be used, or any other appropriate arrangement providing the same functionality as far as opening and closing operations are concerned. The invention is also not limited to any particular type of guiding systems or guiding rails.

Figure 4:
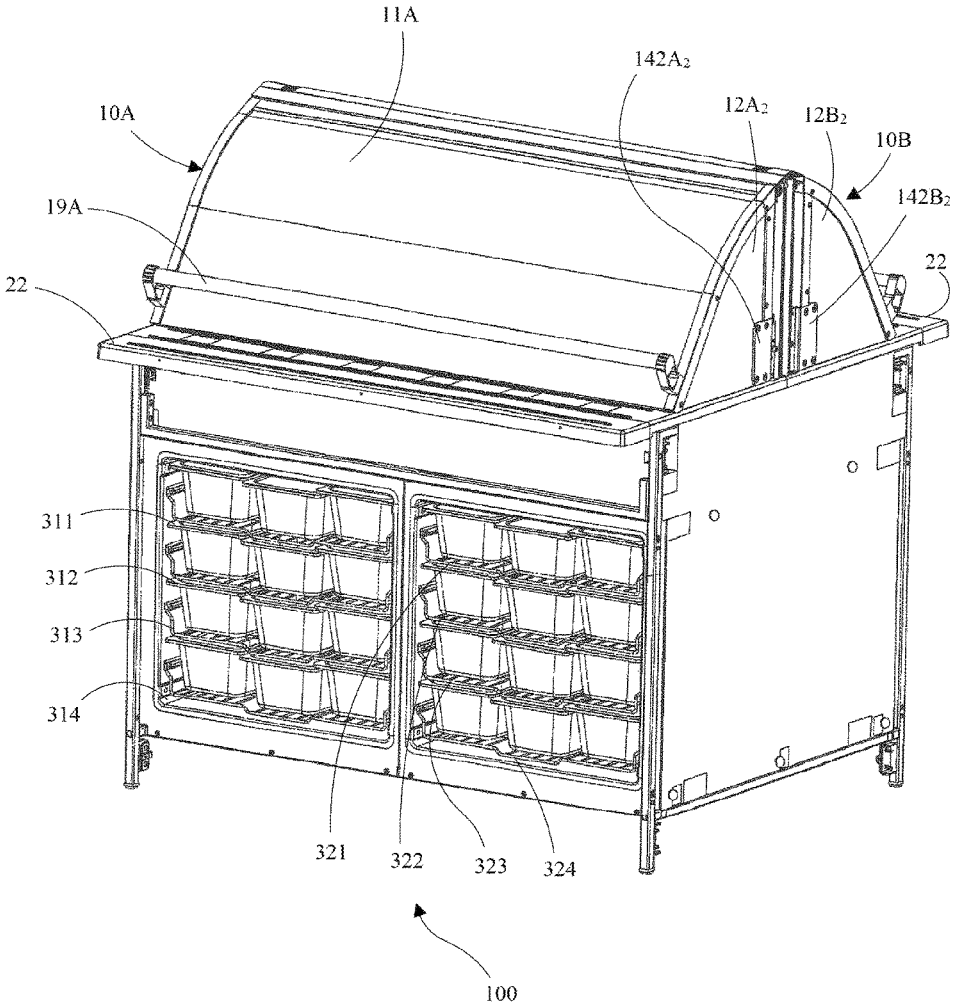
FIG. 4 is a perspective view of the dual food bar arrangement of FIG. 1 illustrating more in detail an embodiment of an operating structure of the covering arrangement.

FIG. 4 schematically illustrates a food bar arrangement 100 with removed front doors with a plurality of shelves 311,312,313,314 and 321,322,323,324 arranged in two cupboard sections disposed side by side. Each shelf here comprises two outer sections and an intermediate section, which is displaced in height with respect to the respective outer sections in order to provide space for as many canteens as possible. It should be clear that this merely relates to one particular embodiment; the shelves may be of any number, shape and size; the cupboard might be divided into one or more sections, and there may also be food bars without any cupboard or canteen holding capability whatsoever, or providing any other desired functionality. In case the canteens do contain food products, they are preferably kept at an appropriate temperature by means of the refrigerating arrangement, or another separate or adjunct cooling system.

Figure 5:
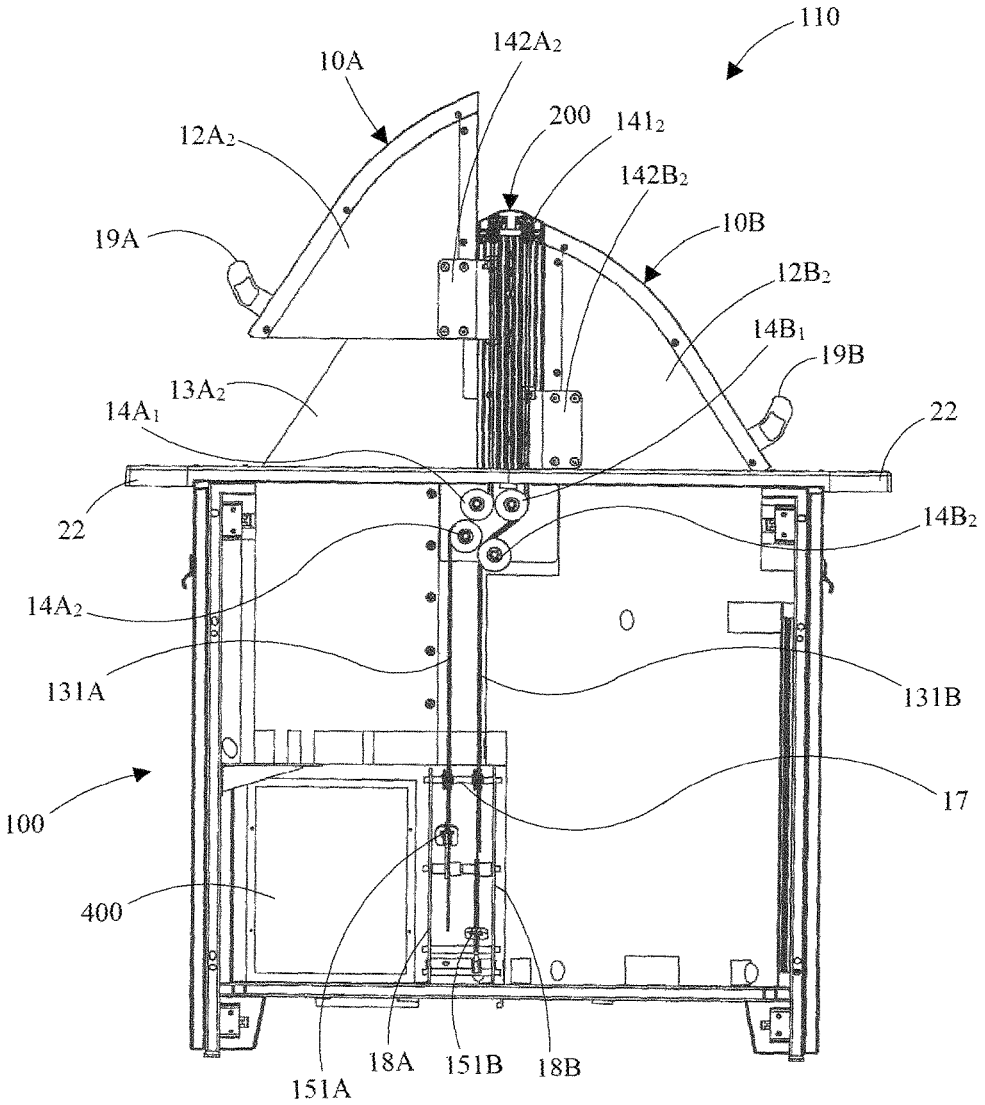
FIG. 5 is a cross-sectional side view of the arrangement shown in FIG. 3 with one covering element in an open position and the other in a closed position.

FIG. 5 is a side view of the covering arrangement 110 seen from the side with removed side wall in FIG. 2. Similar elements are indicated using the same reference numerals. A machine room 400 is schematically illustrated in which e.g. an evaporator and a compressor of a cooling system may be provided which may be in communication with the cooling arrangement 200, which however merely relates to an advantageous embodiment of a food bar arrangement in association with which the covering arrangement 110 of the present invention may be used.

The second side sections 13$A_1$ (not shown in this FIG.), 13$A_2$ may according to different embodiments be fixedly, or detachably, connected to, either the mounting structure 141$_1$ (not shown in this FIG.), 141$_2$ or the respective mounting elements, or alternatively fixedly or detachably connected to the food bar holding arrangement 103. They may alternatively be connected to the covering elements 10A,10B, e.g. to inner sides of the first side sections 12$A_2$, 12$B_2$ of the covering elements in a sliding manner, e.g. via cooperating grooves and nuts or by means providing a similar functionality, and securable by means of appropriate fastening means to the food bar arrangement 100, for example to the holding arrangement 103.

Figure 6:
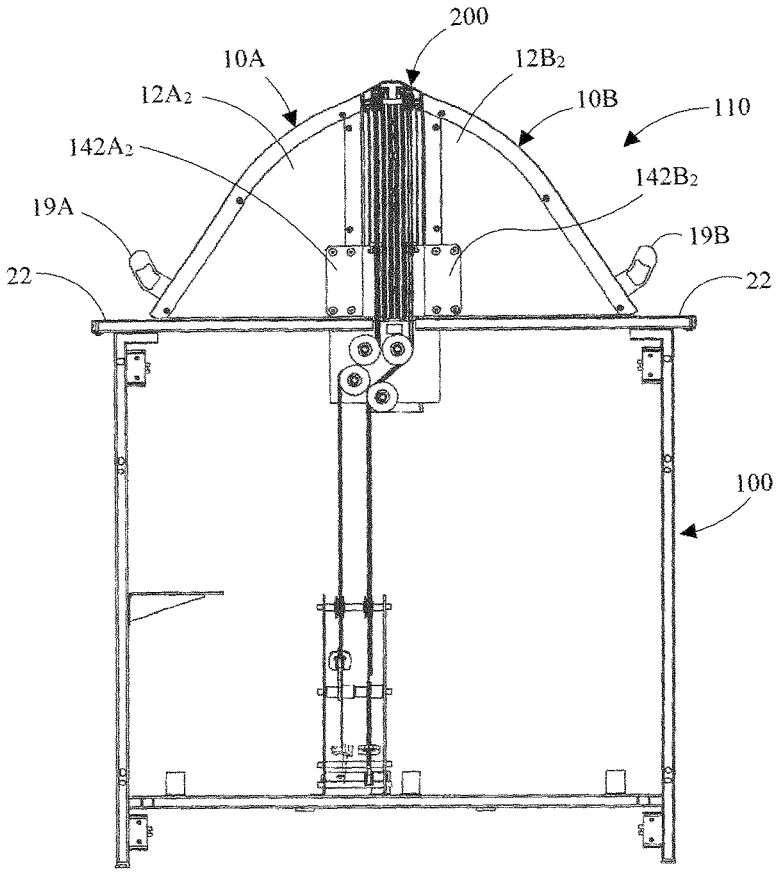
FIG. 6 is a cross-sectional side view of the arrangement shown in FIG. 5 with both covering elements in a closed position.

FIG. 6 shows the covering arrangement 110 mounted on a food bar arrangement in a similar view as FIG. 5, but with both covering elements 10A,10B in a closed position.

Figure 7:
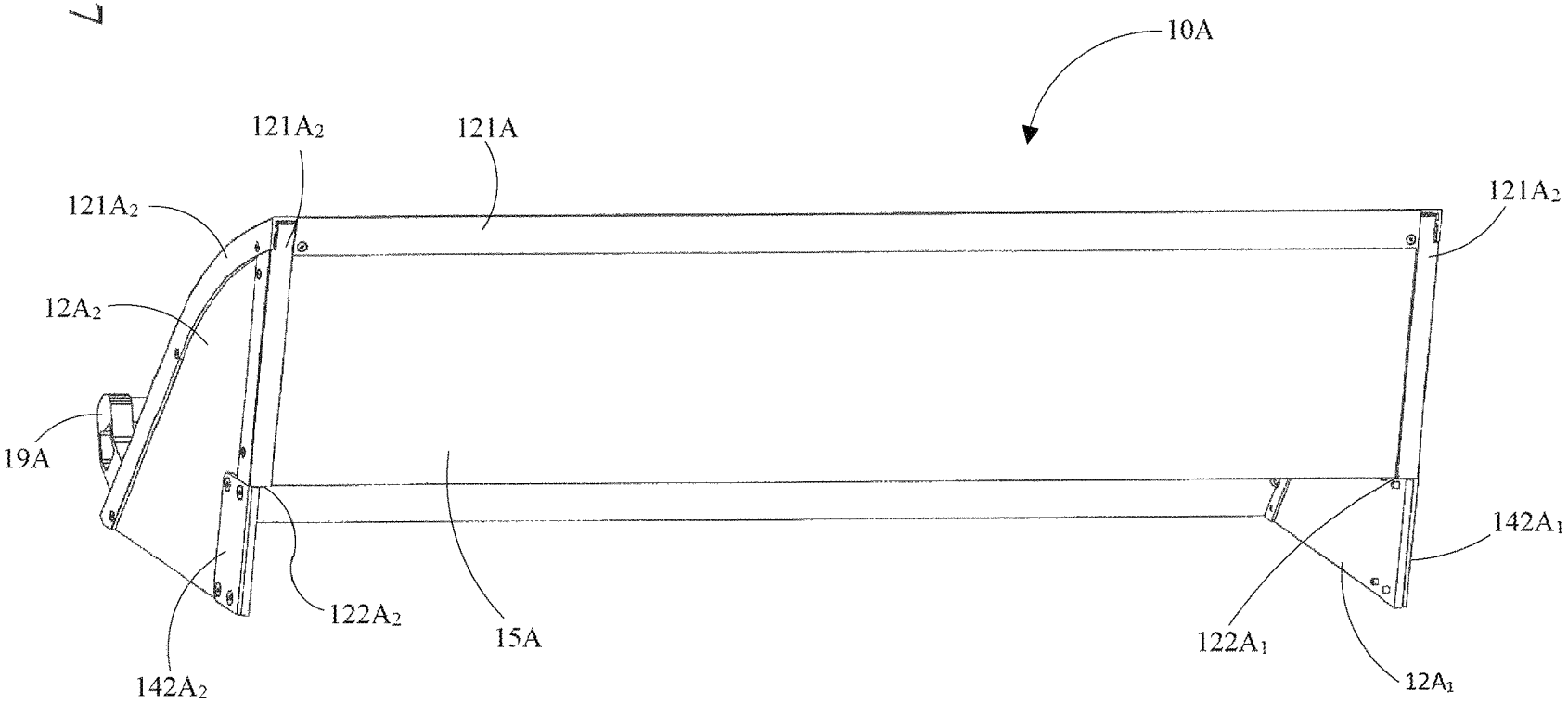
FIG. 7 is a perspective view of a covering arrangement according to one embodiment of the invention.

FIG. 7 is a rear view of a covering element 10A comprising two first side sections 12$A_1$, 12$A_2$, a rear section 15A, a gripping element 19A mounted in a frame structure which comprises an upper frame element 121A and two respective front and rear side frame elements 121$A_1$, 121$A_2$.

At the lower ends 122$A_1$, 122$A_2$, of the rear side frame elements a respective slide 142$A_1$, 142$A_2$ or a carriage is provided. Said slides 142$A_1$, 142$A_2$ or carriages are adapted to slide in guiding rails as discussed with reference to FIGS. 2 and 3. The rear side frame elements end at a position at a distance corresponding to the length of the respective slide 142$A_1$,142$A_2$ in a vertical direction in its mounted state at which also the rear frame section 15A ends.

The height of the rear frame section in a mounted state thereof is smaller than that of the side sections 12$A_1$, 12$A_2$ in a preferred embodiment since it is adapted for being mounted on a food bar arrangement with a refrigerating element extending adjacent to the rear section 15A, the purpose of the shorter dimension of the height of the rear section 15A is to allow cooling by means of the refrigerating element. When the covering element 10A is lifted or elevated to the open position, a larger area of the cooling element will be exposed or uncovered, thus at least to some extent compensating for the warmer air entering the space above the canteens when the covering element 10A is in an open position. Hence a good or a similar cooling capability will be provided independently of whether the cover element 10A is in an open or in a closed position.

In some embodiments auxiliary fans (not shown) may be used to further compensate for cooling losses when the cooling elements are in an open position, for example at high temperatures in the surroundings, or such fans may also be implemented as an additional means.

The covering arrangement is arranged so as to leave a space above the canteens allowing air to circulate due to the cooled air flowing outwards, (particularly downwards due to the inclination of the canteens 8 in some embodiments) over the food, since cool air has a lower density.

It should be clear that the invention is not limited to the specifically illustrated embodiments, but that it can be varied in a number of ways within the scope of the appended claims. Particularly it is not limited to any particular number of covering elements, sizes and shapes of covering arrangements or covering elements, nor of the mounting structure, nor of the materials used. In different embodiments the frame structure of the covering element may be made of Al, stainless steel, an alloy with similar properties or of a plastic material.

Also the covering arrangements, or specifically the covering elements, may be adapted for use with food bars, specifically holding arrangement, which are adapted for taking up one row of canteens, it may be square shaped to take up four rows of canteens arranged with a cooling arrangement in the center of pair wise oppositely arranged canteen back walls, or it may even comprise a circular or oval holding arrangement with surrounding canteens with correspondingly adapted shapes of the canteens or the canteen back walls. The shape and the size of the covering arrangement is then adapted correspondingly, the main issues being that it is movable in a vertical direction, is provided, preferably but not necessarily, with both of, first and second side sections, and with one or more rear sections facing a cooling or refrigerating arrangement, and so disposed that it in an opened position leaves a larger area of the cooling arrangement free, hence partly compensating for the losses in cooling that occur during opening.

The invention claimed is:

1. A covering arrangement for a food bar for holding food, the covering arrangement being changeable between a closed position, in which the food is covered, and an open position, in which the food is accessible, comprising:

at least two covering elements, each covering element having a front section, a rear section, and two first side sections disposed between and interconnecting the front and rear sections along opposite outer edges thereof, the rear section extending in a substantially vertical plane in a mounted state of the covering arrangement;

a mounting structure having at least first and second mounting elements extending in a substantially vertical direction in the mounted state of the covering arrangement arranged at rear outer edges of the first side sections and/or outer edges of the rear section, each covering element being vertically movable with respect to the at least first and second mounting elements or being enabled by the at least first and second mounting elements to move between a lower closed position and an upper open position; and two second side sections fixedly or detachably connected to the food bar, such that when each of the at least two covering elements is in the lower closed position, the first side sections are disposed adjacent to and substantially in parallel with the second side sections, and when the covering element is in the upper open position, the second side sections operate as side covers or side walls;

wherein the at least two covering elements have rear sections arranged in parallel to face each other, the at least two covering elements being disposed on either side of a cooling element such that in an open position of a covering element of the at least two covering elements, a larger area of the cooling element on a side facing the covering element in the open position is revealed, and in a closed position of the covering element of the at least two covering elements, a smaller area of the cooling element is revealed.

2. The covering arrangement of claim 1, wherein the rear section has a lower edge which, in the mounted state, ends at a position that is located above a position at which a lower edge of the front section is located, and that is a position at which lower edges of the first side sections are located.

3. The covering arrangement of claim 1, wherein at least the front section is made of a transparent material.

4. The covering arrangement of claim 1, wherein the second side sections are made of a transparent material.

5. The covering arrangement of claim 1, wherein the front, rear, and first side sections are mounted in a frame.

6. The covering arrangement of claim 1, wherein the first and second mounting elements are configured for mounting the covering arrangement on the food bar.

7. The covering arrangement of claim 1, wherein the first and second mounting elements comprise guide rails configured for a slide or carriage arranged on rear outer edges of the first and second mounting elements, whereby the at least two covering elements are movable between the closed and open positions by sliding along the guide rails.

8. The covering arrangement of claim 7, wherein the slide or carriage is disposed on the mounting structure at a rear, lower edge of a respective first side section in association with or close to the lower edge of the rear section.

9. The covering arrangement according to claim 7, wherein the mounting structure comprises an upper roller or trolley around which a wire for a respective covering element runs, which via at least a lower roller or trolley, is connected to an end of a spring pivotally mounted and fixed in a bracket at its other end, whereby the covering elements are separately spring-loaded such that opening and closing a covering element is eccentrically controlled by the spring pivoting over a pivot point when exposed to a force; and a force required to move the covering elements from the open position to the closed position is greater than a force required to bring the covering elements over the pivot point when the covering elements are moved from the closed positon to the open position.

10. The covering arrangement of claim 1, wherein the first and second mounting elements comprise gas springs.

11. The covering arrangement of claims 1, wherein the first and second mounting elements comprise telescopic elements.

12. The covering arrangement of claim 1, wherein the mounting structure is common for the two covering elements, and guide rails are provided on opposite sides of each of the at least first and second mounting elements for taking up respective slides of oppositely disposed mounting elements.

13. The covering arrangement of claim 1, wherein the mounting structure comprises separate mounting elements, each having a guide rail for a respective covering element, and guide rails being provided on one side of each mounting element for taking up a respective slide of the respective mounting element.

14. The covering arrangement of claim 1, further comprising sensor elements adapted to, upon detection of at least one predetermined event, control opening and closing the covering elements by providing a signal to a mechanism for driving movement of the covering elements.

15. The covering arrangement of claim 1, wherein the covering arrangement is demountably connectable to the food bar.

16. A covering arrangement for a food bar for holding food, the covering arrangement being changeable between a closed position, in which the food is covered, and an open position, in which the food is accessible, comprising:

a food bar for holding food;

at least one covering element having a front section, a rear section, and two first side sections disposed between and interconnecting the front and rear sections along opposite outer edges thereof, the rear section extending in a substantially vertical plane in a mounted state of the covering arrangement;

a mounting structure having at least first and second mounting elements extending in a substantially vertical direction in the mounted state of the covering arrangement arranged at rear outer edges of the first side sections and/or outer edges of the rear section, the at least one covering element being vertically movable with respect to the at least first and second mounting elements or being enabled by the at least first and second mounting elements to move between a lower closed position and an upper open position; and two second side sections fixedly or detachably connected to the food bar, such that when the at least one covering element is in the lower closed position, the first side sections are disposed adjacent to and substantially in parallel with the second side sections, and when the covering element is in the upper open position, the second side sections operate as side covers or side walls;

wherein the food bar is single-sided or dual-sided and has a cooling system with a cooling element extending behind a rear section of the at least one covering element or between two rear sections of two covering elements, and an upper edge of the cooling element is located at substantially the same height as a longitudinal upper edge of the rear section when the at least one covering element is in the closed position, such that a larger area of the cooling element facing the rear section is revealed when the at least one covering element is in the open position.

* * * * *